US012071839B2

(12) United States Patent
Fuxa et al.

(10) Patent No.: US 12,071,839 B2
(45) Date of Patent: Aug. 27, 2024

(54) FRACTURE SYSTEM AND METHOD

(71) Applicant: Baker Hughes Oilfield Operations LLC, Houston, TX (US)

(72) Inventors: Jason Fuxa, Houston, TX (US); Wilfred Provost, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/941,064

(22) Filed: Sep. 9, 2022

(65) Prior Publication Data

US 2024/0084682 A1 Mar. 14, 2024

(51) Int. Cl.

| | |
|---|---|
| ***E21B 43/26*** | (2006.01) |
| ***E21B 34/06*** | (2006.01) |
| ***E21B 34/14*** | (2006.01) |
| ***E21B 44/00*** | (2006.01) |

(52) U.S. Cl.

CPC ..... *E21B 43/26* (2013.01); *E21B 34/14* (2013.01); *E21B 2200/06* (2020.05)

(58) Field of Classification Search

None

See application file for complete search history.

(56) References Cited

U.S. PATENT DOCUMENTS 8,657,018 B2 * 2/2014 Cravatte ..... E21B 34/14 166/376
9,546,537 B2 * 1/2017 Greci ..... E21B 43/08
2013/0277059 A1 * 10/2013 Holderman ..... E21B 34/08 166/373
2014/0158368 A1 * 6/2014 Hofman ..... E21B 34/142 166/373
2014/0224471 A1 * 8/2014 Coon ..... E21B 34/108 166/53
2015/0218906 A1 8/2015 Clem et al.
2015/0337624 A1 * 11/2015 Themig ..... E21B 34/063 166/317
2019/0071953 A1 * 3/2019 Saraya ..... E21B 43/26
2021/0156235 A1 * 5/2021 Yin ..... E21B 33/12

* cited by examiner

*Primary Examiner* — Matthew Troutman
*Assistant Examiner* — Douglas S Wood
(74) *Attorney, Agent, or Firm* — CANTOR COLBURN LLP

(57) ABSTRACT

A fracture tool and a system includes a housing having a port, a sleeve disposed adjacent the housing and movable relative to the housing between a first position where the sleeve blocks the port and a second position where the sleeve unblocks the port, and a biaser operably connected between the housing and the sleeve. The biaser biases the sleeve to the first position. A method for fracturing a formation and producing a fluid includes opening a fracture sleeve, shifting a pressure-operated valve from an unarmed position to an armed position based upon the opening of the fracture sleeve. The method further includes applying fracture pressure to the formation, allowing the fracture sleeve to automatically close, actuating the valve with applied pressure, and flowing fluid through the valve. A borehole system including a borehole in a subsurface formation, and a fracture and production system disposed in the borehole.

23 Claims, 10 Drawing Sheets

FRACTURE SYSTEM AND METHOD

BACKGROUND

In the resource recovery and fluid sequestration industries, fracturing is helpful to enhance fluid mobility within a borehole to formation interface. Fracture systems currently include various technologies but still have drawbacks that reduce efficiency and increase potential remedial actions. The art will well receive additional alternative technologies.

SUMMARY

An embodiment of a fracture tool including a housing having a port, a sleeve disposed adjacent the housing and movable relative to the housing between a first position where the sleeve blocks the port and a second position where the sleeve unblocks the port, and a biaser operably connected between the housing and the sleeve, the biaser biasing the sleeve to the first position.

An embodiment of a fracture and production system including a housing having a fracture port and an inflow port, a pressure openable and automatically closable fracture sleeve disposed in the housing, the fracture sleeve having a first position that blocks the fracture port and a second position that unblocks the fracture port, and a pressure activated inflow valve positioned to control fluid flow through the inflow port.

An embodiment of a method for fracturing a formation and producing a fluid including opening a fracture sleeve, shifting a pressure operated valve from an unarmed position to an armed position based upon the opening of the fracture sleeve, applying fracture pressure to the formation, allowing the fracture sleeve to automatically close, actuating the valve with applied pressure, and flowing fluid through the valve.

An embodiment of a borehole system including a borehole in a subsurface formation, and a fracture and production system disposed in the borehole.

An embodiment of a pressure activated valve including a housing having a seal bore, a valve piston assembly disposed in the housing, the assembly movable from a position outside of the seal bore to a position sealed in the seal bore, the assembly being unarmed while outside of the seal bore and armed when disposed in the seal bore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
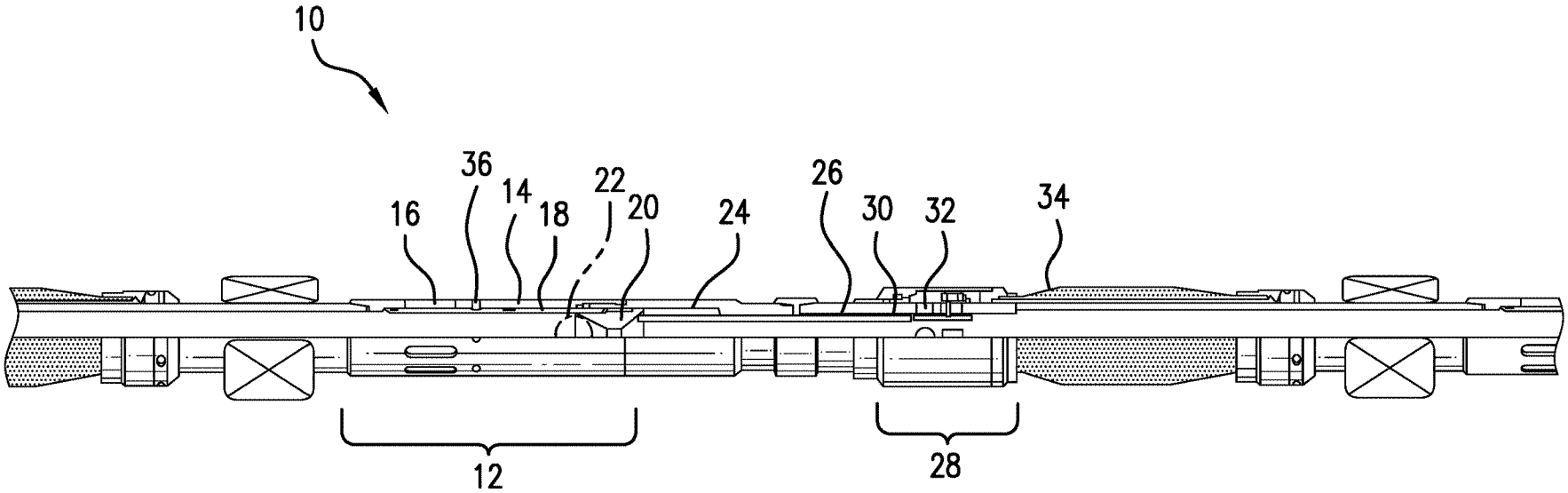
FIG. 1 is a view of a fracture and production system.

Referring to FIG. 1, a view of a fracture and production system 10 is illustrated. The system includes a fracture tool 12 comprising a housing 14 having a fracture port 16 therein extending from an inside diameter of the housing to an outside diameter of the housing so that fluid connectivity from inside the housing 14 to outside thereof is possible. A fracture sleeve 18 is disposed within the housing 14 and movable between a first position where the port 16 is blocked and a second position wherein the port 16 is unblocked. It is possible for the sleeve 18 to be moved between the first and second position even if the ultimate first and second positions are not reached. The sleeve 18 includes a seat 20 that is receptive to an object 22 such that when the object 22 is landed on the seat 20 a pressure differential may be established across the seat 20 based upon applied pressure. The pressure differential will cause the seat 20 and the attached sleeve 18 to move to the second position where the port 16 is unblocked. Further, a biaser 24 is in operable connection with the sleeve 18 and biases the sleeve 18 to the first position where the port 16 is blocked. The biaser may in an embodiment be a spring. The biaser 24 may be disposed between the sleeve 18 and the housing 14 and in an embodiment is configured to act in compression to bias the sleeve 18 to the first position. Also connected to the sleeve 18 is an extension 26. Extension 26 extends toward another component of the system 10 for the purpose of changing a condition of that component. As illustrated, the extension 26 interacts with a pressure activated valve 28 to change the valve 28 from an unarmed position to an armed position. In an embodiment this is accomplished by the extension 26 physically shifting the valve 28. This will be further discussed later in this application. Returning to the extension 26, in some embodiments, the extension includes a seal 30 that functions to seal an inflow port 32 of system 10 during fracturing activity to prevent early actuation of the valve 28 due to leakage of pressure past seat 20. The fracture sleeve 18 hence responds to applied pressure to open fracture port 16 for a fracturing operation through port 16 and then automatically closes as pressure is bled off due to the action of the biaser 24. It is further noted that the system 10 may include a filter media 34 disposed in the fluid path between inflow port 32 and an environment outside of the system 10. In some embodiments, it is desirable to include a releaser 36 securing the sleeve 18 to the housing 14 until the object 22 affords the opportunity to build sufficient pressure differential across the seat 20 to cause release of the releaser 36. In embodiments the releaser may be a shear screw or equivalent.

Figure 2:
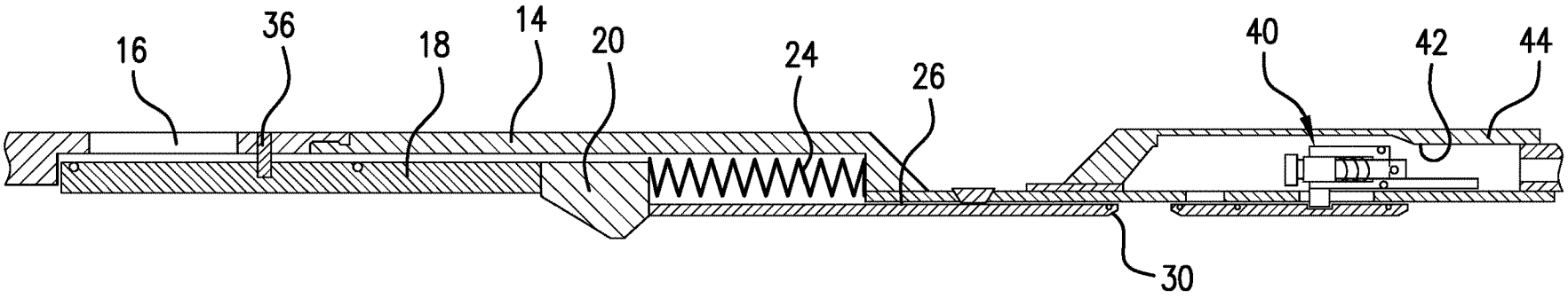
FIGS. 2-7 are sequential views of operation of the system disclosed herein.
Figure 3:
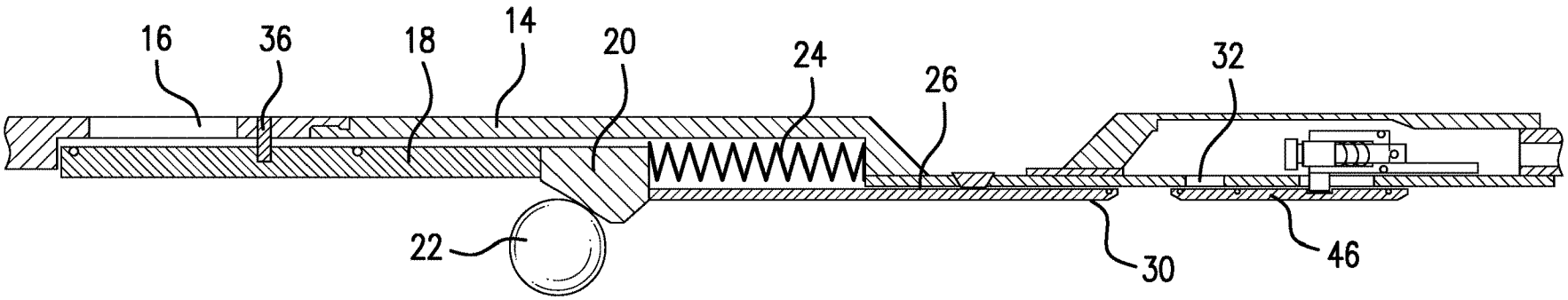

Referring to FIGS. 2-7 a sequence of operations that include run in through fracturing through production using the system 10 are illustrated. In FIG. 2, the system 10 is in a position associated with run in. The sleeve 18 is in the first position and the valve 28 is unarmed. Referring to FIG. 3, the object 22, which is sized to land on the seat 20 has landed thereon. Those of skill are familiar with the concept of sizing balls or objects and seats to allow for sequential landing on seats from the most downhole to the most uphole using the smallest object on the first (most downhole) and progressively working to the largest object on the last seat (least downhole).

Figure 4:
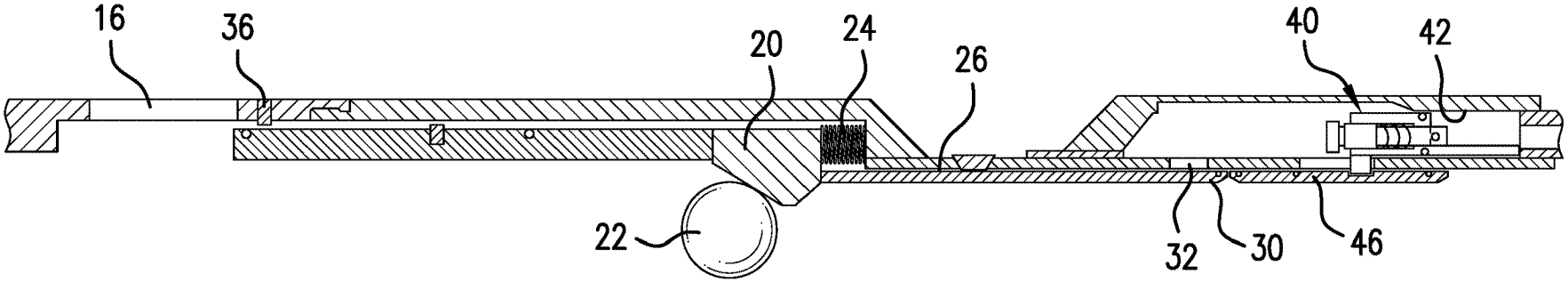

Moving to FIG. 4, the object 22 is on seat 20 and pressure has been applied. The pressure differential across the seat causes the seat 20 along with sleeve 18 to move in the downhole direction after a threshold differential associated with release of the releaser 36 has been reached. It will be appreciated that in this position fluid associated with the applied pressure can escape the port 16 to act on a formation 38 outside of the system 10 thereby fracturing and possibly propping the fracture open. In this position seal 30 has sealed off inflow port 32 as noted above. FIG. 4 also provides insight when juxtaposed with FIG. 3 regarding the valve 28. That will now be explained fully. The valve 28 in the run in position of system 10 is in a position where fluid pressure to which it is exposed will be the same over its surface and hence it does not react to such application of pressure. This ensures that the valve 28 does not prematurely actuate. It will be appreciated in FIGS. 2 and 3 that the valve 28 includes a valve piston assembly 40 that is not in a seal bore 42 of a valve housing 44. In FIG. 4 however, the assembly 40 has been shifted into the bore 42 and creates a seal there. In this position, the valve piston assembly does experience differential pressure across itself. It will be appreciated that the extension 26 is the cause of the shift in assembly 40 since that assembly 40 is connected to a valve sleeve 46 that is abutted by the extension 26 as shown in FIG. 4. It is further to be noted that the sleeve 46 also moves out of sealing engagement with inflow port 32 thereby opening the same but for the position of extension 26 while the fracturing operation is ongoing.

Figure 5:
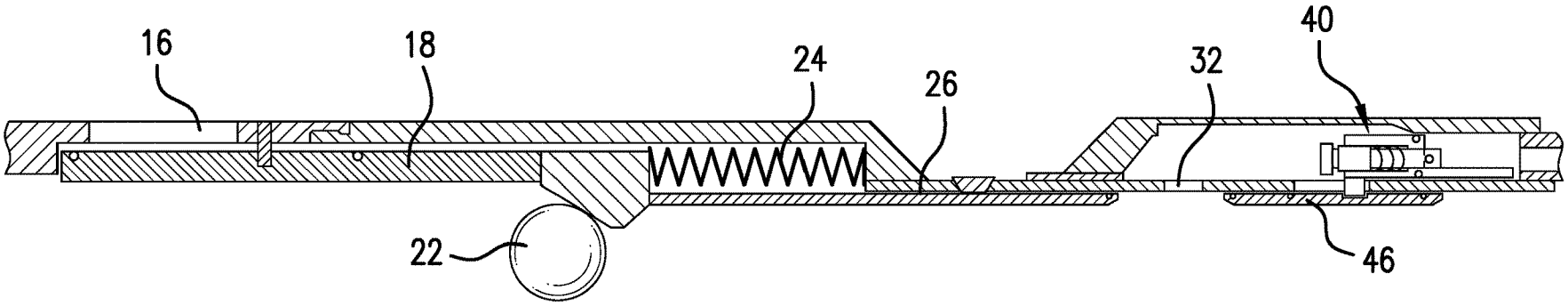

Referring to FIG. 5, the applied pressure has been relieved such that the biaser 24 has returned the sleeve 18 to the first position closing the port 16. The extension 26 has also retracted along with the sleeve 18 from the valve 28 leaving sleeve 46 in the shifted position and opening the inflow port 32.

Figure 6:
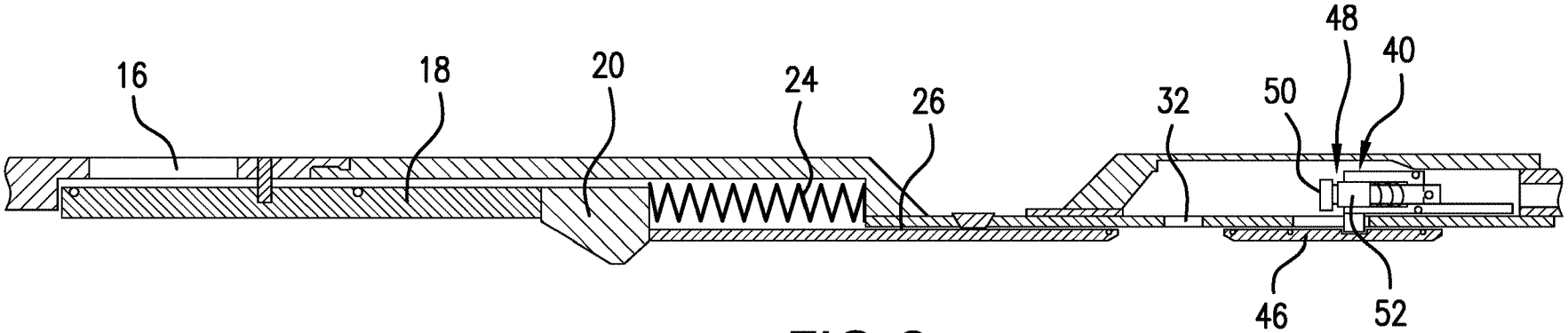

FIG. 6 illustrates the system 10 after the object 22 is flowed back to surface, dissolved or otherwise removed as an impediment to flow and pressure downhole of the seat 20. The valve 28 is still closed at this point but is now armed and can be opened using applied pressure. It is to be appreciated that there is a small gap 48 that can be seen between a piston 50 of the assembly 40 and a pin ring 52 of the assembly 40. This is important in relation to the FIG. 7 view where the gap 48 is no longer present. This is because in FIG. 7, pressure has been applied to the armed valve 28 to actuate the same. The applied pressure gets to the assembly 40 through inflow port 32.

Figure 7:
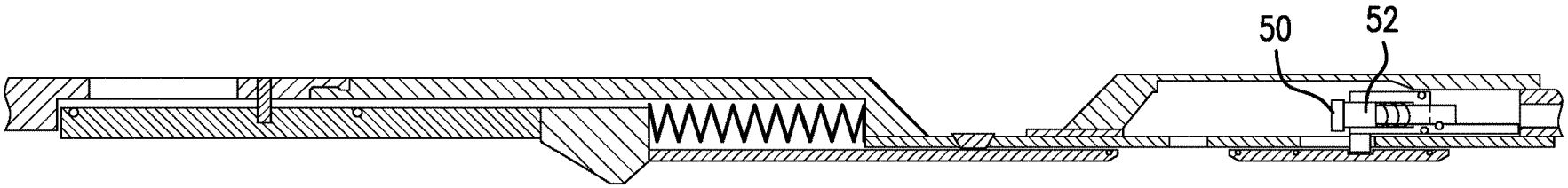
Figure 8:
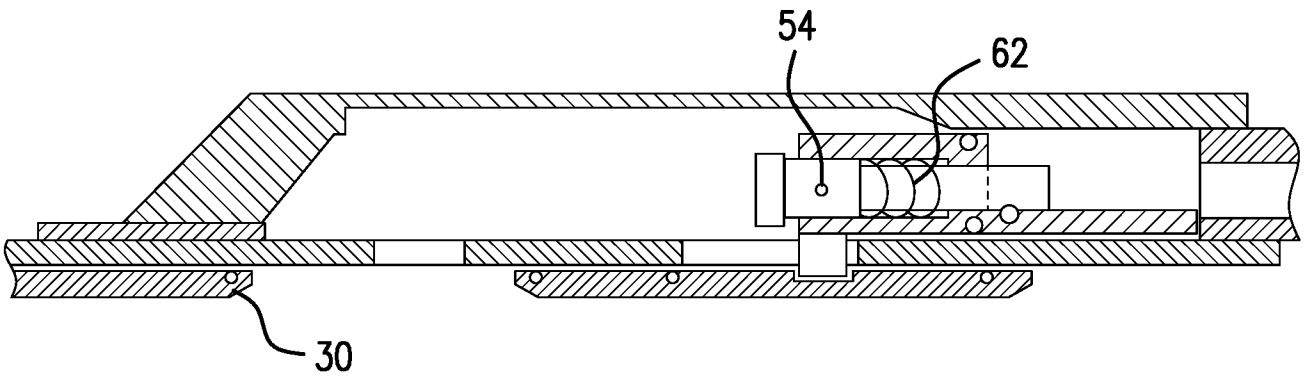
FIGS. 8 and 9 are enlarged views of the valve portion of the system illustrated in FIGS. 1-7.
Figure 9:
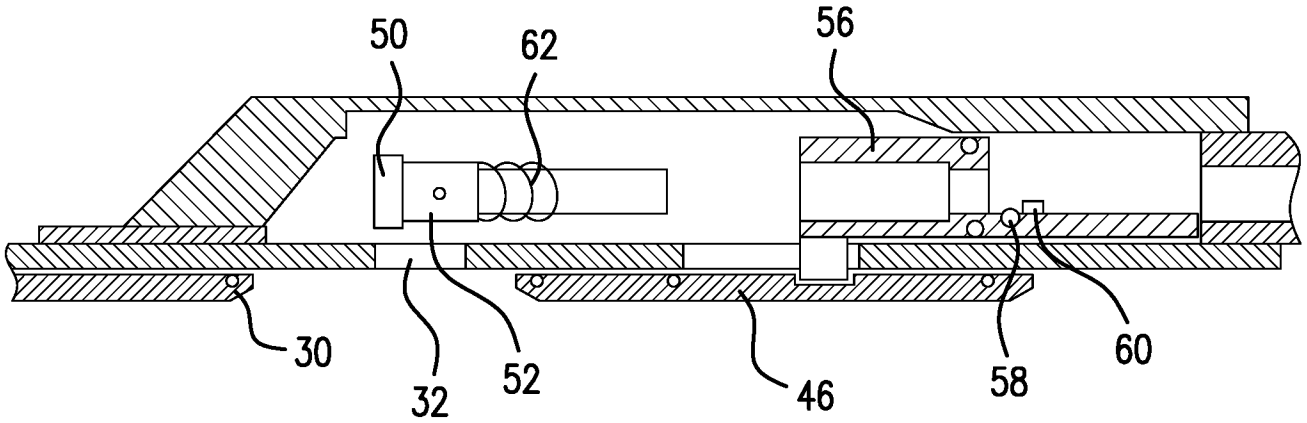

Referring to Figured 8 and 9, an enlarged view of the valve 28 is illustrated for better clarity. FIG. 8 is the same position as FIG. 7 and FIG. 9 is after the applied pressure is relieved. During the applied pressure, as noted the gap 48 is closed which breaks pin 54 that formerly locks piston 50 to the pin ring 52. Pin ring 52 sits in a collar 56 but is not secured there. Rather a lock bearing 58 is partially captured in a part of the collar 56 and partially captured in the piston 50. When the gap 48 is dispensed with due to applied pressure, the lock bearing is released and either falls away or is drawn away by magnets 60. At this point the piston and pin ring are free to be expelled from the collar 56 by a spring 62. In this position, production may take place through the inflow port 32 and may come through the filter material 34.

Figure 10:
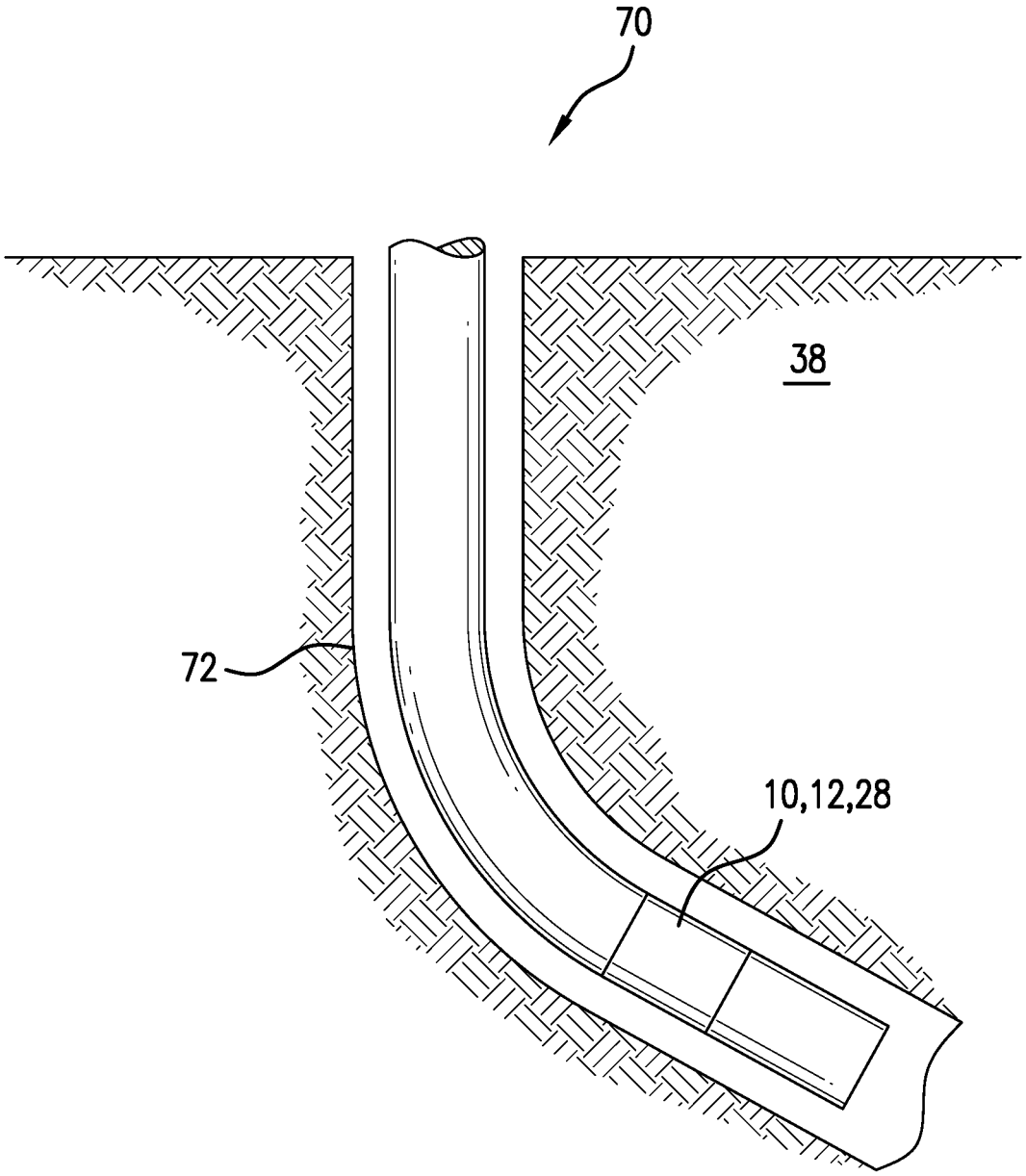
FIG. 10 is a view of a borehole system inclining the fracture and production system as disclosed herein.

Referring to FIG. 10, a borehole system. The system 70 comprises a borehole 72 in a subsurface formation 38. A system 10, fracture tool 12 or valve 28 as disclosed herein is disposed within the borehole 72.

Set forth below are some embodiments of the foregoing disclosure:

Embodiment 1: A fracture tool including a housing having a port, a sleeve disposed adjacent the housing and movable relative to the housing between a first position where the sleeve blocks the port and a second position where the sleeve unblocks the port, and a biaser operably connected between the housing and the sleeve, the biaser biasing the sleeve to the first position.

Embodiment 2: The tool as in any prior embodiment, wherein the sleeve further includes a seat.

Embodiment 3: The tool as in any prior embodiment, wherein the seat is receptive to an object so that a pressure differential is establishable across the seat, the differential moving the sleeve toward the second position.

Embodiment 4: The tool as in any prior embodiment, wherein a reduction in differential pressure across the seat results in the sleeve moving toward the first position under the influence of the biaser.

Embodiment 5: The tool as in any prior embodiment, wherein the biaser is a spring.

Embodiment 6: The tool as in any prior embodiment, wherein the sleeve includes an extension that interacts with another component upon movement toward the second position.

Embodiment 7: A fracture and production system including a housing having a fracture port and an inflow port, a pressure openable and automatically closable fracture sleeve disposed in the housing, the fracture sleeve having a first position that blocks the fracture port and a second position that unblocks the fracture port, and a pressure activated inflow valve positioned to control fluid flow through the inflow port.

Embodiment 8: The fracture and production system as in any prior embodiment, where the fracture sleeve includes an extension that changes the valve from an unarmed position on to an armed position.

Embodiment 9: The fracture and production system as in any prior embodiment, where the valve in the unarmed position is pressure balanced.

Embodiment 10: The fracture and production system as in any prior embodiment, where the valve in the armed position is pressure unbalanced.

Embodiment 11: The fracture and production system as in any prior embodiment, where the extension includes a seal that in the second position seals the inflow port.

Embodiment 12: The fracture and production system as in any prior embodiment, where the system includes a biaser operably connected to the fracture sleeve that biases the fracture sleeve toward the first position absent pressure moving the fracture sleeve toward the second position.

Embodiment 13: The fracture and production system as in any prior embodiment, where the system includes a subhousing having a seal bore therein receptive to the valve.

Embodiment 14: The fracture and production system as in any prior embodiment, further including a filter disposed in the flow path of the inflow port.

Embodiment 15: A method for fracturing a formation and producing a fluid including opening a fracture sleeve, shifting a pressure operated valve from an unarmed position to an armed position based upon the opening of the fracture sleeve, applying fracture pressure to the formation, allowing the fracture sleeve to automatically close, actuating the valve with applied pressure, and flowing fluid through the valve.

Embodiment 16: The method as in any prior embodiment, wherein the opening includes landing an object on a seat associated with the fracture sleeve and applying pressure to create a pressure differential across the seat.

Embodiment 17: The method as in any prior embodiment, wherein the allowing is reducing pressure differential across the seat and allowing a biaser to urge the fracture sleeve to a closed position.

Embodiment 18: The method as in any prior embodiment, wherein the opening of the fracture sleeve is carried out sequentially for a plurality of fracture sleeves and the actuating the valve is carried out simultaneously for a plurality of valves.

Embodiment 19: A borehole system including a borehole in a subsurface formation, and a fracture and production system as in any prior embodiment disposed in the borehole.

Embodiment 20: The borehole system as in any prior embodiment, wherein the fracture and production system is a plurality of fracture and production systems disposed within the borehole.

Embodiment 21: The borehole system as in any prior embodiment, wherein fracture sleeves of the plurality of fracture and production systems are actuable sequentially and the valves of the plurality of fracture and production systems are actuable simultaneously.

Embodiment 22: A borehole system including a borehole in a subsurface formation, and a fracture and production system as in any prior embodiment disposed in the borehole.

Embodiment 23: A pressure activated valve including a housing having a seal bore, a valve piston assembly disposed in the housing, the assembly movable from a position outside of the seal bore to a position sealed in the seal bore, the assembly being unarmed while outside of the seal bore and armed when disposed in the seal bore.

Embodiment 24: The valve as in any prior embodiment wherein the assembly is connected to a sleeve disposed outside of the housing.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A fracture tool comprising:

a housing having a fracture port and an inflow port longitudinally axially spaced from the fracture port;

a fracture sleeve disposed adjacent the housing and movable relative to the housing between a first position where the sleeve blocks the port and a second position where the sleeve unblocks the port, the fracture sleeve including an extension;

a biaser operably connected between the housing and the fracture sleeve, the biaser biasing the fracture sleeve to the first position;

a valve sleeve disposed in the housing, the valve sleeve shiftable by the extension to a position where the inflow port is open; and a valve disposed fluidically between the inflow port and an environment outside of the tool, the valve being in an unarmed condition in which the valve does not react to pressure until being shifted to an armed condition by the valve sleeve where the valve is responsive to pressure.

2. The tool as claimed in claim 1, wherein the sleeve further includes a seat.

3. The tool as claimed in claim 2, wherein the seat is receptive to an object so that a pressure differential is establishable across the seat, the differential moving the sleeve toward the second position.

4. The tool as claimed in claim 3, wherein a reduction in differential pressure across the seat results in the sleeve moving toward the first position under the influence of the biaser.

5. The tool as claimed in claim 1, wherein the biaser is a spring.

6. A fracture and production system comprising:

a housing having a fracture port and an inflow port;

a pressure openable and automatically closable fracture sleeve disposed in the housing, the fracture sleeve having a first position that blocks the fracture port and a second position that unblocks the fracture port; and a pressure activated inflow valve positioned to be in a pressure insensitive unarmed condition prior to being physically shifted by the fracture sleeve and then to be in a pressure actuatable armed condition to control fluid flow through the inflow port.

7. The fracture and production system as claimed in claim 6, where the fracture sleeve includes an extension that changes the valve from the unarmed position on to the armed position.

8. The fracture and production system as claimed in claim 7, where the valve in the unarmed position is pressure balanced.

9. The fracture and production system as claimed in claim 7, where the valve in the armed position is pressure unbalanced.

10. The fracture and production system as claimed in claim 7, where the extension includes a seal that in the second position seals the inflow port.

11. The fracture and production system as claimed in claim 6, where the system includes a biaser operably connected to the fracture sleeve that biases the fracture sleeve toward the first position absent pressure moving the fracture sleeve toward the second position.

12. The fracture and production system as claimed in claim 6, where the system includes a subhousing having a seal bore therein receptive to the valve.

13. The fracture and production system as claimed in claim 6, further comprising a filter disposed in the flow path of the inflow port.

14. A method for fracturing a formation and producing a fluid comprising:

opening a fracture sleeve;

physically shifting a pressure operated valve from an unarmed position to an armed position based upon the opening of the fracture sleeve;

applying fracture pressure to the formation;

allowing the fracture sleeve to automatically close;

actuating the valve with applied pressure; and flowing fluid through the valve.

15. The method as claimed in claim 14, wherein the opening includes landing an object on a seat associated with the fracture sleeve and applying pressure to create a pressure differential across the seat.

16. The method as claimed in claim 14, wherein the allowing is reducing pressure differential across the seat and allowing a biaser to urge the fracture sleeve to a closed position.

17. The method as claimed in claim 14, wherein the opening of the fracture sleeve is carried out sequentially for a plurality of fracture sleeves and the actuating the valve is carried out simultaneously for a plurality of valves.

18. A borehole system comprising:

a borehole in a subsurface formation; and a fracture and production system as claimed in claim 7 disposed in the borehole.

19. The borehole system as claimed in claim 18, wherein the fracture and production system is a plurality of fracture and production systems disposed within the borehole.

20. The borehole system as claimed in claim 19, wherein fracture sleeves of the plurality of fracture and production systems are actuable sequentially and the valves of the plurality of fracture and production systems are actuable simultaneously.

21. A borehole system comprising:

a borehole in a subsurface formation; and a fracture and production system as claimed in claim 1 disposed in the borehole.

22. A pressure activated valve comprising:

a housing having a seal bore;

a valve piston assembly disposed in the housing, the assembly movable from a position outside of the seal bore to a position sealed in the seal bore, the assembly being unarmed while outside of the seal bore and armed when disposed in the seal bore.

23. The valve as claimed in claim 22 wherein the assembly is connected to a sleeve disposed outside of the housing.

* * * * *